US008705224B2

(12) United States Patent
Riskin

(10) Patent No.: US 8,705,224 B2
(45) Date of Patent: Apr. 22, 2014

(54) METHOD OF IONS GENERATION AND AERODYNAMIC ION GENERATOR

(76) Inventor: Yefim Riskin, Katzrin (IL)

( * ) Notice: Subject to any disclaimer, the term of this patent is extended or adjusted under 35 U.S.C. 154(b) by 451 days.

(21) Appl. No.: 12/855,245

(22) Filed: Aug. 12, 2010

(65) Prior Publication Data

US 2011/0255206 A1 Oct. 20, 2011

(30) Foreign Application Priority Data

Apr. 19, 2010 (IL) ..... 205302

(51) Int. Cl.
*H01T 23/00* (2006.01)

(52) U.S. Cl.
USPC ..... 361/230

(58) Field of Classification Search
USPC ..... 361/230
See application file for complete search history.

(56) References Cited

U.S. PATENT DOCUMENTS

| | | | | |
|---|---|---|---|---|
| 3,320,151 | A | 5/1967 | Tepe et al. | |
| 4,740,862 | A | 4/1988 | Halock | |
| 5,491,602 | A * | 2/1996 | Horn et al. | 361/228 |
| 6,850,403 | B1 | 2/2005 | Gefter et al. | |
| 7,212,393 | B2 | 5/2007 | Gefter et | |
| 8,009,405 | B2 * | 8/2011 | Gefter et al. | 361/213 |
| 2005/0168907 | A1 | 8/2005 | Sekoguchi et al. | |
| 2007/0210734 | A1 * | 9/2007 | Botvinnik et al. | 318/268 |
| 2011/0094710 | A1 | 4/2011 | Choudhary et al. | |

FOREIGN PATENT DOCUMENTS

| | | |
|---|---|---|
| IL | 150766 | 6/2004 |
| WO | WO 2004/008597 A1 | 1/2004 |

OTHER PUBLICATIONS

International Search Report for PCT Application No. PCT/IL2011/000760 mailed on May 8, 2012.

* cited by examiner

*Primary Examiner* — Jared Fureman
*Assistant Examiner* — Nicholas Ieva

(57) ABSTRACT

A method for generating ions is disclosed. The method includes generating AC high voltage using a stationary AC generator, applying the AC high voltage to one or more AC/DC voltage converters via capacitive air coupling between a high voltage terminal of the AC generator and one or more high voltage terminals of the AC/DC voltage converters. The method also includes rotating the AC/DC voltage converters, each AC/DC voltage converter connected to an air ionizing electrode that rotates with the AC/DC voltage converter it is connected to when that AC/DC voltage converter is rotated, relative to the AC generator, in an air flow. The method further includes providing additional capacitive air coupling between a low voltage terminal of the AC generator and one or more low voltage terminals of the AC/DC voltage converters, and multiplying the voltage output of the AC/DC converters. An ion generator is also disclosed.

14 Claims, 3 Drawing Sheets

METHOD OF IONS GENERATION AND AERODYNAMIC ION GENERATOR

CROSS REFERENCE

The present, application claims priority from IL patent application No. 205302, filed on Apr. 19, 2010.

FIELD OF THE INVENTION

The invention relates to methods for ion generation and to bipolar and unipolar ion generators in which the air ionizing electrodes rotate relative to a fixed AC high voltage generator; it can be applied in industry for removal of static electric charges from objects and also in domestic appliances for regenerating the ionic composition of the air and also for charging the dust particles in air purifiers.

BACKGROUND

Aerodynamic ions generator is well known (see WO/2004/008597(A1) or IL/150766A) in which a high voltage terminal of high voltage AC power supply is via air capacitor and two different polarity diodes is coupled to ion ionizing electrodes.

Aerodynamic ions generator is well known (see WO/2004/008597(A1) or IL/150766A) in which a high voltage terminal of high voltage AC power supply is via air capacitor and two different polarity diodes is coupled to ion ionizing electrodes.

One of the limitations of the invention is the use of the motor shaft for connecting diodes mounted on the rotating part of the motor to the voltage terminal of the fixed AC high voltage generator.

In this case the mechanical contact causes friction and wear of the metal which in the long run reduces the continuous operation time of the device.

Another limitation is the low efficiency of energy transmission from the AC generator to ionizing electrodes which depends on the air capacitor capacitance.

Air capacitor capacitance is determined by the area of the stator and the rotor plates and the gap between them.

Because of very low dielectric constant of air ($\in$) big plate surface is required for energy transmission at a preset frequency of the AC generator, which makes the device bulky.

At the same time an increase of capacitance on the expense of reducing the gap between the plates is limited by a low breakdown voltage of the air of 3 kV/mm.

In practice, at reasonable sizes of the rotor and the stator plates and the gap between them the transmitted voltage does not exceed 5 kV, which prevents from yielding high ion emission currents.

Inventions are well-known in which air ionizing electrodes are implemented with a thin spring stretched with a spring (see for example U.S. Pat. No. 7,212,393.B2).

The limitation of such mechanical solution is that the tension of the wire remains constant during the ions generator operation and the out-of-service time.

Constant tension leads to the fatigue not only of the wire but also of the spring material; therefore taking into consideration the fatigue of materials with time, the tension force of the wire is preset to be higher than the required minimal value.

This leads to non-uniform wire thinning and consequently to non-uniform ions emission along its length.

Further, ion generators are well-known in which the ion emission as maintained constant through the control of the high voltage AC generator. The feedback control signal received from a sensor which is mounted at a certain distance from the air ionizing electrodes and responds to the ion emission level (see for example U.S. Pat. Nos. 4,740,862 and 6,850,403).

The limitation of these inventions is in a very high ions emission level.

This is due to the fact that the ions emission level required for the sensors operation is dozens of times higher than the ions level at the ions generator output.

The high level of the ions emission has two negative consequences:

firstly, the metal emission from the ionizing electrodes is increased, which is extremely undesirable when ion generators are used in the clean rooms of the semiconductors industry;

and secondly, the ozone ($O_3$) level is increased, which is an undesirable byproduct of the ionization process.

DETAILED DESCRIPTION

The purpose of the invention is to eliminate the limitations of the technical solutions currently in use and to gain new advantages.

The proposed ions generation method is based on the following main principles:

1. High voltage AC power supply with relatively low output 3-3.5 kV is used. Power from this generator, stationary mounted like the electric motor, is via capacitive air coupling supplied to the high voltage terminals of the AC/DC voltage converters mounted together with the ionizing electrodes on the rotating parts of the electric motor.

For efficient and contactless energy transmission from the AC generator to the voltage converters an additional capacitive coupling between low voltage terminal of the AC generator and low voltage terminals of the voltage converters is used. Voltage converters function as two- and more fold voltage multipliers.

2. To provide contactless galvanic coupling between the low voltage terminal of the AC generator and the low voltage terminal of voltage converter at unipolar ionization corona discharge in air is used.

3. Each air ionizing electrode is executed as a thin wire, one end of which is connected to the voltage converter output and the other end is left free and wrapped with an insulator.

4. Centrifugal force generated at the electrode rotation is used to straighten the electrodes.

5. No less than two ion current sensors are positioned in the plane parallel to the ionizing electrodes rotation plane, radially at an angle of 180° to each other.

One of the most important characteristics of bipolar ions generators is the balance of the positive and negative ions reached at the generator output.

In bipolar ionization using by the proposed method two interrelated processes occur.

The first process implies ions emission from each of different polarity ionizing electrodes.

The second process implies the return of ions with one polarity to the opposite polarity electrode during the electrodes rotation.

In this way the cumulative ions flow from/to of each electrode is determined by ion emission and deposition.

While equal ions emission is assured due to the absence of galvanic coupling with ground in the AC/DC converter, the amount of ions returned to the ionizing electrodes is not equal because of different mobility of positive and negative ions in the electric field.

The mobility of negative ions is by 25% higher than that of the positive ions; therefore positive imbalance is always generated at the ion generator output.

The imbalance level depends on the electrodes rotation velocity.

In the proposed method the balance of positive and negative ions at the generator output is achieved through rotating different polarity electrodes in two parallel planes. For this purpose the negative electrode is positioned after the positive one in the air drop-flow.

The balance is controlled by adjusting the distance between the electrodes rotation planes at a preset rotation velocity.

Figure 1:
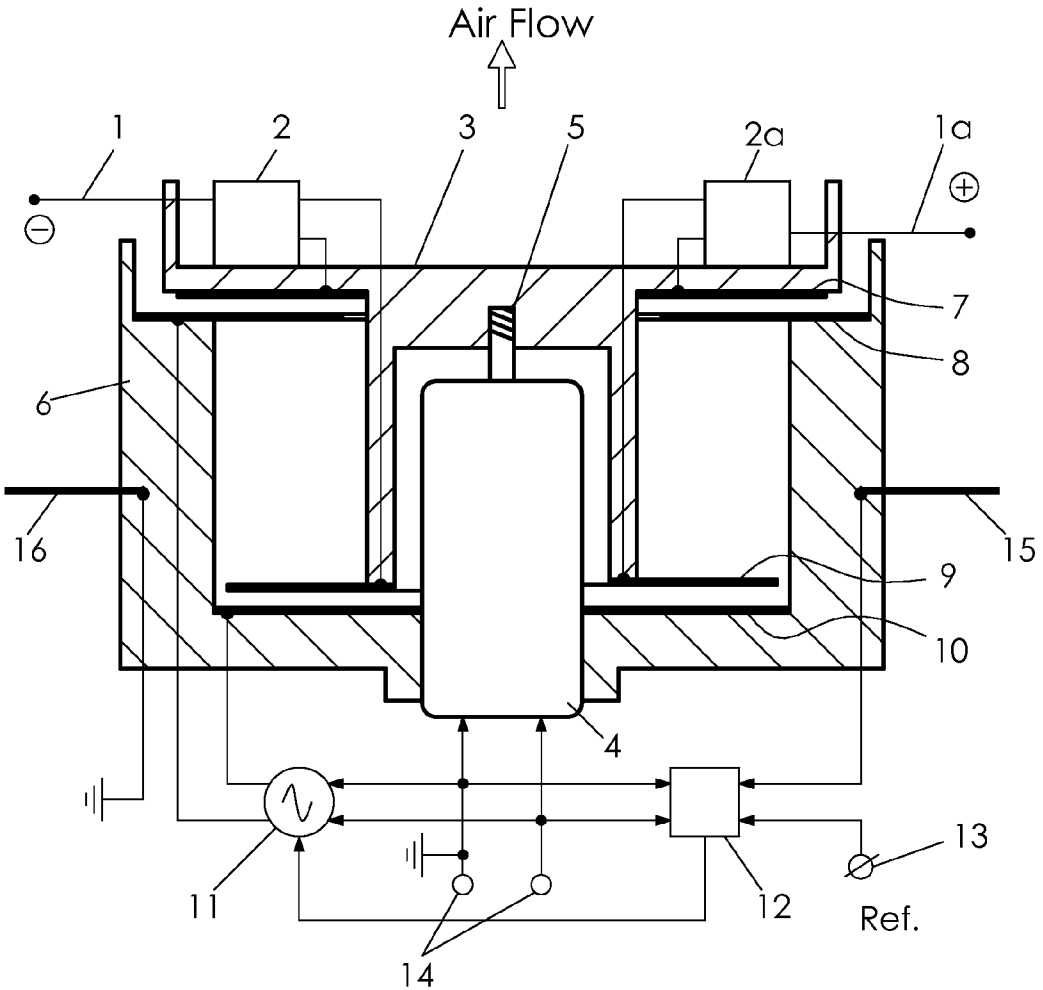
FIG. 1 illustrates an aerodynamic ions generator in accordance with embodiments of the present invention.

The construction of the aerodynamic ions generator realizing the proposed method is illustrated in FIG. 1.

The ions generator comprises ionizing electrodes 1 and 1*a* and voltage converters 2 and 2*a* mounted on the rotating part 3 of electric motor 4 which is fastened to shaft 5 of this motor, and ions generator body 6 in which motor 4 is fastened.

In addition the ions generator comprises: rotor plates 7 and 9 of air capacitors mounted on rotating part 3 and stator plates 8 and 10 of the same capacitors mounted on body 6 in parallel to plates 7 and 9.

Further, ions generator contains high voltage AC generator 11, controller 12 and terminal 13 for reference voltage transmission to controller 12, terminals 14 for power supply to AC generator 11, motor 4 and controller 12, sensors 15 and 16, all of them stationary mounted inside body 6 of the ions generator.

Sensors 15 and 16 are executed as wire pins, their lengths and the distance from ionizing electrodes 1 and 1*a* being experimentally determined to provide the required level of the feedback signal.

One end of each electrode 1 and 1*a* is connected to the outputs of voltage converters 2 and 2*a*, while the other end of each electrode is free and wrapped with an insulator.

The inputs of converters 2 and 2*a* are connected to rotor plates 7 and 9, while stator plates 8 and 10 are connected to the high voltage and low voltage outputs of AC generator 11 respectively, and the control input thereof is connected to the output of controller 12, while one input thereof is connected to sensor 15, and the other input is connected to terminal 13. Sensor 16 is grounded.

At the same time terminals 14 are connected to the power input of AC generator 11, electric motor 4 and controller 12.

Figure 2:
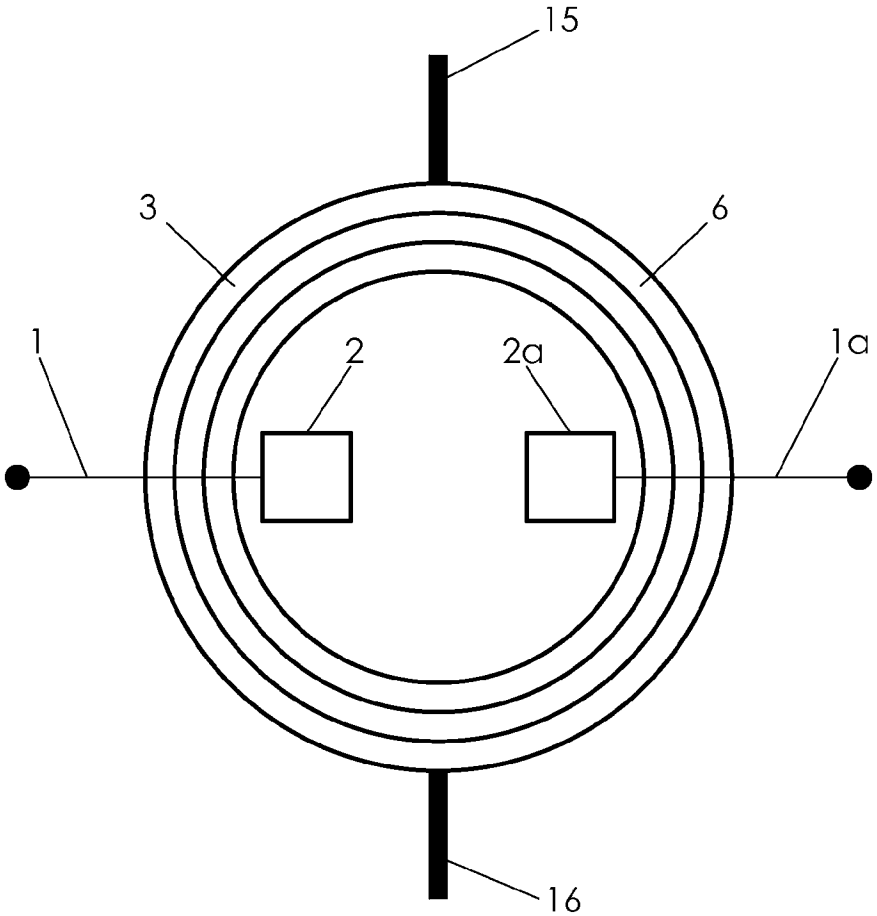
FIG. 2 is a different view of the ions generator which enables better comprehension of the construction details layout, in accordance with embodiments of the present invention.

FIG. 2 is a different view of the ions generator which enables better comprehension of the construction details layout.

Figure 3:
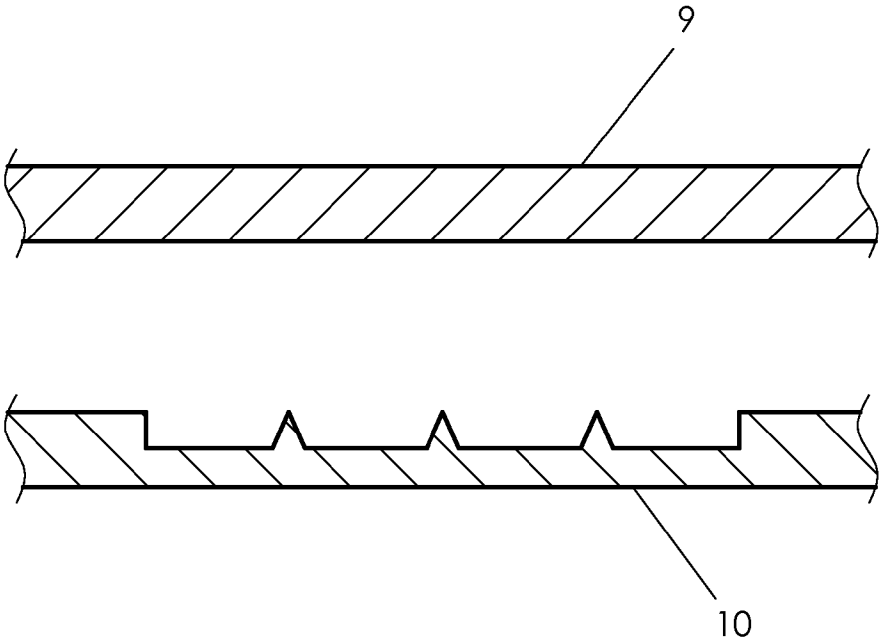
FIG. 3 illustrates the shape of a stator plate of an additional air capacitor used in a unipolar ion generator, in accordance with embodiments of the present invention.

FIG. 3 illustrates the shape of the stator plate of an additional air capacitor used in case of unipolar ionization.

In case of bipolar ionization the aerodynamic ions generator operation is as follows:

AC generator 11 via air capacitors comprising rotor and stator plates 7 & 9 and 8 & 10 respectively transmit power to voltage converters 2 and 2*a*, assembled according to a classical Cockcroft-Walter scheme which converts AC voltage to different polarity DC voltages with a preset multiplication factor.

There is no need in galvanic coupling between the low potential terminal of AC generator 11 and low potential terminals of converters 2 and 2*a* since the capacitor charging currents of different polarity converters 2 and 2*a* are mutually subtracted and quasi-null is generated on rotor plate 9 relative to voltage converter outputs 2 and 2*a*.

Since electrodes 1 and 2 with one end of each of them being connected to the outputs of converters 2 and 2*a* are executed as thin wire the ions emission takes place along the entire length of the wire.

In order to prevent excessive ion emission from the free ends of the electrodes these ends are wrapped with an insulator.

Pull-up of the wire forming electrodes 1 and 1*a* is achieved by centrifugal force generated at the electrodes rotation.

The wire tension force is adjusted by adjusting the rotation velocity of rotor part 3 of electric motor 4.

Such approach enables to set the desired wire tension force by adjusting the rotational speed of electric motor 4 and at the same time to remove the tension during out-of-service time.

Because of electrodes 1 and 1*a* rotation the ions emission occurs from a big surface, which constitutes one of the advantages of the proposed generator.

When the electrodes 1 and 1*a* pass under sensors 15 and 16 during rotation, a signal is generated by sensor 15 and applied to controller 12 where it is compared with the reference voltage ($U_{ref}$) applied to terminal 13.

Controller 12 produces an AC generator 11 control signal, which varies the input voltage thereof according to the signal level. Sensor 16 is designated only to maintain the ion balance conditions; it can be either used together with sensor 15 or grounded.

Sensors 15 and 16 are executed as wire pins, their length and the distance from ionizing electrodes 1 and 1*a* being experimentally determined to provide the required level of the feedback signal.

In this way feedback exists only when electrodes 1 and 1*a* pass above sensors 15 and 16.

This provides the proposed generator another advantage over the existing generators with feedback control in which the feedback signal is continuously read thus increasing ozone ($O_3$) generation.

At unipolar ionization only one AC/DC converter is used (say, 2). This requires galvanic coupling between AC generator 11 and voltage converter 2.

In order to provide this coupling between the low voltage terminal of generator 11 and converter 2 one part of additional air capacitor 9 or 10 is formed with sharp fragments (for example, needles). See FIG. 3.

These fragments provide generation of corona discharge between parts 9 and 10 once a certain voltage is reached between them; in this way galvanic coupling comes into existence via the galvanic current of the corona discharge zone without mechanical contact.

The inventor constructed a conceptual specimen of aerodynamic ions generator with the following characteristics:

| | |
|---|---|
| AC generator high voltage | 3.5 kV |
| AC generator frequency | 50 kHz |
| Number of voltage multiplying cascades | 3 |
| Voltage across the electrodes | ±10 kV |
| Diameter of electrodes | 0.1 mm |

-continued

| | |
|---|---|
| Ionization area | 0.3 $m^2$ |
| Number of electric motor rpm | 600 rpm |
| Balance | ±2 V |
| Ozone | 3 ppb |

What is claimed is:

1. A method for generating ions comprising:

generating AC high voltage using a stationary AC generator;

applying the AC high voltage to one or more AC/DC voltage converters via capacitive air coupling between a high voltage terminal of the AC generator and one or more high voltage terminals of said one or more AC/DC voltage converters;

rotating said one or more AC/DC voltage converters, each of said one or more AC/DC voltage converters connected to an air ionizing electrode that rotates with the AC/DC voltage converter it is connected to when that AC/DC voltage converter is rotated, relative to the AC generator, in an air flow;

providing additional capacitive air coupling between a low voltage terminal of the AC generator and one or more low voltage terminals of said one or more AC/DC voltage converters, and multiplying the voltage output of the AC/DC converters.

2. A method as claimed in claim 1, wherein said one or more AC/DC converters comprises one AC/DC converter, the method comprising facilitating corona discharge between a low potential terminal of the AC generator and a low potential terminal of the AC/DC voltage converter.

3. A method as claimed in claim 1 wherein each air ionizing electrode comprises a wire having two ends, one end of which is connected to one of said one or more AC/DC voltage converters and the other end is free and insulated.

4. A method as claimed in claim 3 comprising applying centrifugal force to straighten the electrodes.

5. A method as claimed in claim 1, comprising providing one or more ion current sensors to sense changes in ion generation from the air ionizing electrodes.

6. A method as claimed in claim 5, wherein said one or more ion current sensors include two ion current sensors positioned in a plane parallel to a rotation plane of the air ionizing electrodes, substantially at an angle of 180°.

7. A method as claimed in claim 1, wherein said one or more AC/DC voltage converters comprises two AC/DC converters of different polarities, the method comprising rotating the air ionizing electrode connected to the AC/DC convertor of the negative polarity in a plane that is located downstream the air flow with respect a plane of rotation of the air ionizing electrode connected to the AC/DC convertor of the positive polarity.

8. A method as claimed in claim 7 comprising adjusting the distance between the different rotation planes.

9. An aerodynamic ions generator comprising:

an electric motor with a stator and a rotor;

a high voltage AC generator coupled to the stator;

one or more AC/DC voltage converters mounted on the rotor, each of said one or more AC/DC voltage converters connected to an air ionizing electrode;

an air capacitor having a stator plate and a rotor plate, the stator plate of the first capacitor connected to a high voltage terminal of the AC generator and the rotor plate of the first air capacitor connected to one or more high voltage terminals of said one or more AC/DC voltage converters;

an additional air capacitor with a stator plate and a rotor plate, the stator plate of the additional capacitor connected to a low potential terminal of the high voltage AC generator, and the rotor plate of the additional capacitor connected to one or more low voltage terminals of said one or more AC/DC voltage converters, wherein said one or more AC/DC voltage converters are each designed as a voltage multiplier.

10. A generator as claimed in claim 9, wherein one of the plates of the additional air capacitor includes sharp fragments to facilitate corona discharge between the plates of this capacitor.

11. A generator as claimed in claim 9 wherein the air ionizing electrode comprises a wire having two ends, one end of which is connected to one of said one or more AC/DC voltage converters and the other end is free and insulated.

12. A generator as claimed in claim 9 wherein said one or more AC/DC voltage converters comprises two AC/DC converters, of different polarities, and wherein the air ionizing electrodes are rotatable in different planes.

13. A generator as claimed in claim 9 comprising two ion current sensors to sense changes in ion generation from the air ionizing electrodes.

14. A generator as claimed in claim 13, wherein the distance of said one or more sensors from the air ionizing electrode is adjustable.

* * * * *